United States Patent [19]

Hartman et al.

[11] Patent Number: 4,592,660

[45] Date of Patent: Jun. 3, 1986

[54] WATCH PROTECTOR

[76] Inventors: James Hartman, 22732 Berdon St., Woodland Hills, Calif. 91367; Blake Schwartzman, 6548 Sausalito Ave., Canoga Park, Calif. 91307

[21] Appl. No.: 670,473

[22] Filed: Nov. 9, 1984

[51] Int. Cl.[4] ..... G04B 37/00

[52] U.S. Cl. ..... 368/286; 368/281

[58] Field of Search ..... 368/286

[56] References Cited

U.S. PATENT DOCUMENTS

| | | | |
|---|---|---|---|
| 1,199,256 | 9/1916 | Farr | 368/286 |
| 1,249,906 | 12/1917 | Daw | 368/286 |
| 2,511,105 | 6/1950 | Fenynessy | 224/4 |
| 2,565,822 | 8/1951 | McClelland | 368/286 |
| 2,582,473 | 1/1952 | Belfert | 224/4 |
| 2,635,416 | 4/1953 | Mietchen | 368/282 |
| 3,712,049 | 1/1973 | Luxembourg | 224/4 D |
| 4,277,842 | 7/1981 | Richards | 368/282 |
| 4,511,261 | 4/1985 | Michima | 368/286 |

FOREIGN PATENT DOCUMENTS

| | | | |
|---|---|---|---|
| 102641 | 12/1916 | United Kingdom | 368/286 |
| 105694 | 4/1917 | United Kingdom | 368/286 |
| 106357 | 5/1917 | United Kingdom | 368/286 |
| 103815 | 6/1917 | United Kingdom | 368/286 |
| 110048 | 10/1917 | United Kingdom | 368/286 |

*Primary Examiner*—Bernard Roskoski

*Attorney, Agent, or Firm*—Koppel & Harris

[57] ABSTRACT

A watch protector has a guard member extending across the face of the watch and two ring members, each attached at an end of the guard member. Each ring member has a cross-piece extending between opposite sides of the ring member for dividing the ring member into two openings, one closer to the guard member, and the other more distant from the guard member. At least one of the openings of each ring member receive portions of the watch band. The guard member having a vertical dimension extending upward from the face of the watch greater than the vertical dimension of the ring members when the ring members are aligned with the guard member for added protection.

3 Claims, 5 Drawing Figures

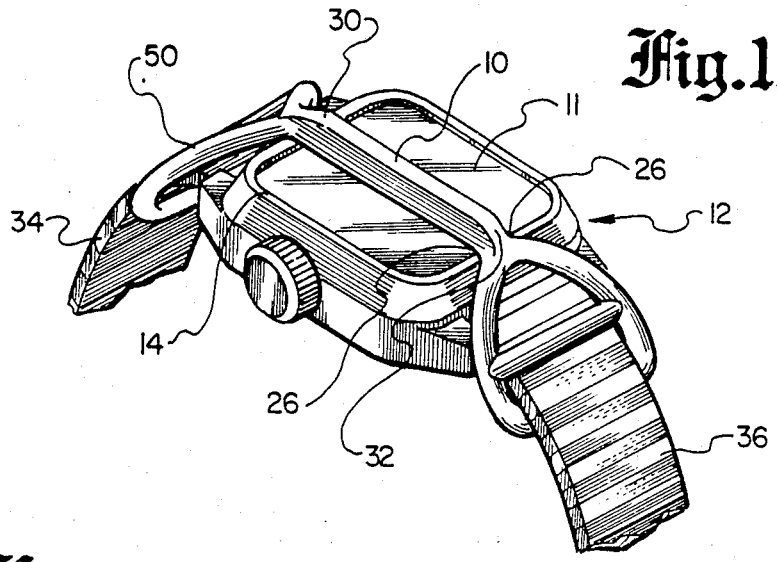
Fig.1.
Fig.2.
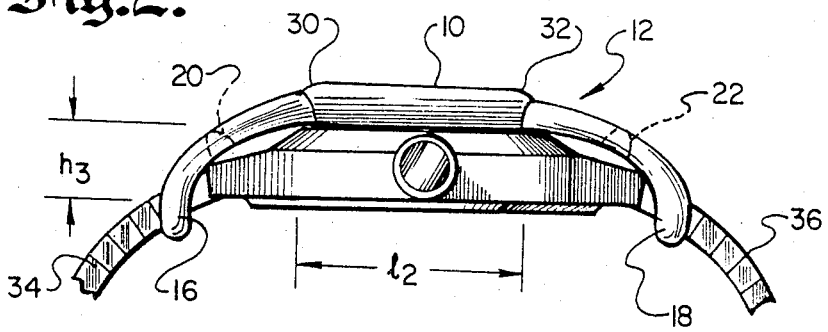
Fig.3.
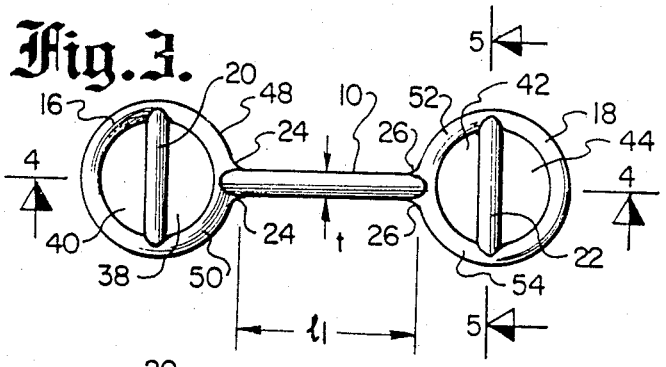
Fig.5.
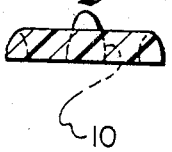
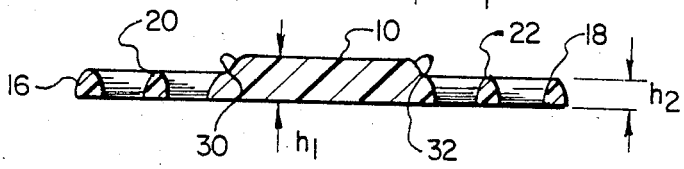
Fig.4.

WATCH PROTECTOR

BACKGROUND OF THE INVENTION

1. Field of Invention

This invention relates to a device for protecting the crystal of a watch face to guard the crystal from being damaged through bumping or scratching.

2. Description of the Prior Art

There are several devices that protect a watch crystal. One of the best known is the hinged cover, which is especially common in pocket watches. The cover, usually of metal and frequently of precious metal, is hinged to the back of the watch. One of disadvantages of a hinged cover is that it always covers the face of the watch. It protects well, but it must be moved manually to view the watch. Another device that has the same drawback is a flexible plastic or rubber cover having a central slit. The watch fits into the cover, and the slit is spread apart to view the watch face and hands. Good protection is offered, but the protective benefits are outweighed by the inconvenience of use.

Another protector attaches to the band and has a relatively thin rubber or plastic member extending from the bands across the face of the watch. This device offers protection and does not cover most of the watch face. It has had a somewhat limited commercial success because, it is believed, it broke easily and did not actually guard the crystal well enough. Relatively light, especially glancing blows directly at the watch crystal would not be stopped by the watch protector.

SUMMARY OF THE INVENTION

It is an object of the present invention a watch protector that allows viewing of the watch face and hands or digital readout, that protects the watch face well and is rugged.

The present invention meets these objects by having a watch protector that has a central watch guard member extending across the watch face. On the ends of the watch guard are two ring members, each having a central cross-piece dividing the rings into two openings, one nearer and one farther from the watch. The bands of the watch are threaded through the farther opening of each ring and are held by the cross-pieces and the ring portions surrounding the farther opening such that the guard member lies on the crystal of the watch and is supported by the portion of the ring forming the more rear opening. The guard member is relatively thin and has a vertical height that extends above the height of the rings when the watch protector is lying flat. The sides of the guard member curve upward from the ring members at the ends of the guard member. The guard member also has slightly wider ends where it intersects with the ring members to create more strength in the ring members.

BRIEF DESCRIPTION OF THE DRAWINGS

FIG. 1 is a perspective view of the watch protector of the present invention mounted on a wrist watch.

FIG. 2 is a side view of the watch protector of the present invention mounted on a wrist watch.

FIG. 3 is a plan view of the watch protector independent of the wrist watch.

FIG. 4 is a side, sectional view of the watch protector of the present invention taken through plane 4—4 of FIG. 3.

FIG. 5 is an end view of the watch protector of the present invention taken through plane 5—5 of FIG. 3.

DETAILED DESCRIPTION OF THE PREFERRED EMBODIMENT

The watch protector of the present invention includes a guard member 10 which extends across the crystal 11 of wrist watch 12. Face 14 of watch 12 is square or rectangular, but it could also be circular. Guard member 10 has a height dimension $h_1$ (FIGS. 2 and 4) and a thickness t (FIG. 3). Height $h_1$ is greater than thickness t as shown in the comparison in FIGS. 3 and 4.

Ring members 16 and 18 are attached to or integral with guard member 10. In the exemplary embodiment, the ring members are generally circular and have a height $h_2$ (FIG. 4), which is less than the height $h_1$ of guard member 10. Each ring member 16, 18 has a cross-piece 20, 22.

The watch protector of the present invention is formed of one piece of material. In the exemplary embodiment, the material chosen is a silicone rubber, which is flexible and resilient. For strength, guard member 10 intersects rings 16 and 18 at somewhat wider portions 24 and 26 (FIGS. 1 and 3). Height $h_1$ is greater than height $h_2$ because an increased height for the guard member is useful for adding protection. A taller guide member protects against harder blows. Also, if an object pushes it over, more area of the watch face is covered. It is not advisable, however, to increase the thickness of rings 16 and 18 or cross members 20 and 22 because increasing that thickness makes it more difficult to attaching watch bands 34 and 36 to the ring members, which is accomplished in the following manner.

Cross-piece 20 divides the area inside ring 16 into two spaces, space 38, which is closer to the watch, and space 40 which is farther from the watch (FIG. 3). Likewise, cross-piece 22 divides the area inside ring 18 into two spaces, space 42 and 44. As FIGS. 1 and 2 show, band 34 is threaded through space 40 and under cross-piece 20, and band 36 goes through space 42 and under cross-piece 22. The guard member is supported by arms 48 and 50 extending from the sides of cross-piece 20, and by arms 52 and 54 extending from the sides of cross-piece 22. Arms 48 and 50 and arms 52 and 54 from triangles with the respective cross-piece for strength and stability.

As an alternative (not shown), the watch bands can be threaded through the ring members differently. Band 34 would be threaded through space 38, over cross-piece 20, and back through space 40. Band 36 would go through space 42, over cross-piece 22 and down through space 42. Band 36 The guard member is supported by arms 48 and 50 extending from the sides of cross-piece 20, and by arms 52 and 54 extending from the sides of cross-piece 22.

The length $l_1$ of guard member 10 is chosen to be compatible with the length $l_2$ of the watch and the height $h_3$, which is the distance from top edge of the crystal to the point watch bands 34 and 36 connect to the watch 12. Essentially, length $l_1$ should be such that when watch bands 34 and 36 are threaded through spaces 40 and 42 of rings 16 and 18 as shown in FIGS. 1 and 2, guard member 10 lies generally flat with curved portions 30 and 32 bending downward from the top of the crystal as shown in FIG. 2. Because of the bending along the end of guard member 10, the added thickness of the guard member and the curvature at its ends helps prevent breakage of guard member 10 at this important region.

Various other modifications and changes may be made in the configuration described above that come within the spirit of the invention. The invention embraces all such changes and modifications coming within the scope of the appended claims.

We claim:

1. A watch protector comprising a resilient guard member for extending across the face of the watch and two flexible ring members, each ring member being attached at an end of the guard member and having a cross-piece extending between opposite sides of the ring member for dividing the ring member into two openings, one closer to the guard member and the other more distant from the guard member, at least one of the openings or each ring member receiving portions of a watch band extending from opposite sides of the watch, the guard member extending as a single member across the center of the watch, the guard member having a vertical dimension extending upward from the face of the watch greater than the vertical dimension of the ring members when the ring members are aligned with the guard member.

2. The watch protector of claim 1 wherein the top of the guard member is generally flat along its mid-section and curves downward at the portions that engage the ring member.

3. The watch protector of claim 1 wherein the guard member is of a generally even thickness through its center and has wider portions at its end adjacent the intersection of the guard member to the rings to add strength at the connection between the guard members and the rings.

* * * * *